US005186426A

United States Patent [19]

Wada

[11] Patent Number: 5,186,426

[45] Date of Patent: Feb. 16, 1993

[54] RAIL ATTACHMENT STRUCTURE

[75] Inventor: Kouichi Wada, Koshigaya, Japan

[73] Assignee: Tachikawa Corporation, Japan

[21] Appl. No.: 805,183

[22] Filed: Dec. 10, 1991

[51] Int. Cl.[5] ..... A47H 1/14

[52] U.S. Cl. ..... 248/251; 16/94 R; 160/902; 248/265

[58] Field of Search ..... 248/251, 254, 256, 258, 248/261, 262, 265, 266, 267, 269, 273; 160/902, 38, 78.1; 16/94 R, 94 D

[56] References Cited

U.S. PATENT DOCUMENTS

| | | | |
|---|---|---|---|
| 3,029,465 | 4/1962 | Graber et al. | 248/265 X |
| 4,919,185 | 4/1990 | Comeau et al. | 160/902 X |
| 4,949,926 | 8/1990 | Liu | 160/902 X |
| 5,074,350 | 12/1991 | Carter | 160/902 X |

FOREIGN PATENT DOCUMENTS 1-76995 5/1989 Japan .

*Primary Examiner*—Ramon O. Ramirez
*Attorney, Agent, or Firm*—Limbach & Limbach

[57] ABSTRACT

Disclosed is a fixture structure for fixing a rail member to an attaching surface, such as a wall. The frame to be attached to the attaching surface has a first support for supporting a first attaching piece of a rail member. The slide block, attached slidable to the frame, has a second support for supporting a second attaching piece of the rail member. The slide block slides between a supporting position where the second support can support the second attaching piece and a releasing position where the second support releases the second attaching piece. A spring is provided to urge the slide block toward the support position. The slide block has an actuating piece whose position can be changed to a direction different from a direction of the slide block sliding. When the slide block is shifted to the release position, the actuating piece engages with a part of the frame to hold the slide block at that position. When the second attaching piece of the rail member is shifted toward the slide block with the first attaching piece of the rail member held by the first support, the actuating piece changes its position to disengage from the part of the frame based on the engagement with the rail member. This movement allows the slide block to move toward the support position by the urging force of the spring.

14 Claims, 4 Drawing Sheets

RAIL ATTACHMENT STRUCTURE

BACKGROUND OF THE INVENTION

1. Field of the Invention

The present invention relates to a rail attachment structure where a rail member, such as a head box for a blind, is securely fixed to an attaching surface, such as the upper portion of a window frame.

2. Description of the Related Art

Conventionally, a head box for a blind is fixed on the upper portion of a window frame by a fixture, as disclosed in, for example, Japanese Unexamined Utility Model Publication No. 1-76995. The fixture includes a frame 31 and a slide block 32 as shown in FIG. 5. The slide block 32 is supported by the frame 31 to be slidable back and forth, and is urged forward by a spring 33. Hooks 34 are provided at the front end of the frame 31 to support the front upper edge of a head box 37. Hooks 35 are provided at the rear end of the slide block 32 to hold the rear upper edge of the head box 37.

To attach the head box 37 to the fixture, the front edge of the head box 37 is hooked on the hooks 34 of the frame 31.

The head box 37 is then pushed up, and the rear edge of the head box 37 touches the hooks 35 of the slide block 32 to move the slide block 32 backward against the force of the spring 33. The rear edge of the head box 37 then goes over the hooks 35 of the slide block 32 and is hooked on the hooks 35. At the same time, the hooks 35 are pressed against the rear edge of the head box 37, so that the head box 37 is securely fixed to the fixture.

The slide block 32 has a push bar 36 protruding forward over the frame 31. When the push bar 36 is pressed in, the hooks 35 of the slide block 32 are disengaged from the rear edge of the head box 37, allowing for removable of the head box 37.

In the conventional head box fixture as described above, however, the spring 33 should have a rather large urging force to securely hold the head box 37. This is because blind components, such as many slats, are hanging from the head box 37. When the head box 37 is to be attached, the urging force of the spring 33 becomes a load for a worker. Thus installation, requiring good strength. The spring 33 with a smaller urging force will cause the head box 37 to be insecurely held. The spring 33 therefore has to be designed to keep a balance between providing the force required for attachment and yet not having such a strong urging force so as to result in cumbersome operation.

In general, fixtures are provided in at least two locations in the lengthwise direction of the head box 37. Since greater operational force is required to attach the head box 37 to the fixtures at the same time, the head box 37 is therefore usually attached to the fixtures one after another. This is troublesome work. The work to remove the head box 37 is also tiresome, because the rear edge of the head box 37 has to be unhooked from the hooks 35 while keeping the push bar 36 pushed in the frame against the spring 33.

SUMMARY OF THE INVENTION

The present invention is intended to solve the above problems, and it is therefore an object of the present invention to provide a head box attachment structure which ensures easy attachment or removal of the head box by a small operational force without the need to push a head box upward against the large force of a head box holding spring.

To achieve the object, a rail attachment structure according to the present invention includes a frame and a slide block. The frame is arranged to be attached to an attaching surface, such as a wall. It includes a first support for supporting a first attaching piece of a rail member. The slide block, is slidably attached to the frame and has a second support for supporting a second attaching piece of the rail member. The slide block slides between a supporting position where the second support can support the second attaching piece and a releasing position where the second support releases the second attaching piece. A spring is provided to urge the slide block toward the support position. The slide block has an actuating piece whose position can be changed to a direction different from the direction that the slide block slides. When the slide block is shifted to the release position, the actuating piece engages with a part of the frame to hold the slide block at that position. When the second attaching piece of the rail member is shifted toward the slide block with the first attaching piece of the rail member held by the first support, the actuating piece changes its position to disengage from the part of the frame based on the engagement with the rail member. This movement allows the slide block to move toward the support position by the urging force of the spring.

BRIEF DESCRIPTION OF THE DRAWINGS

The novel features of the present invention are set forth with particularity in the appended claims. The invention, together with the objects and advantages thereof, may best be understood by reference to the following description of the presently preferred embodiments together with the accompanying drawings in which:

DETAILED DESCRIPTION OF THE PREFERRED EMBODIMENT

A preferred embodiment of the present invention as applied to a head box attachment structure will now be described referring to FIGS. 1 to 4.

Figure 2:
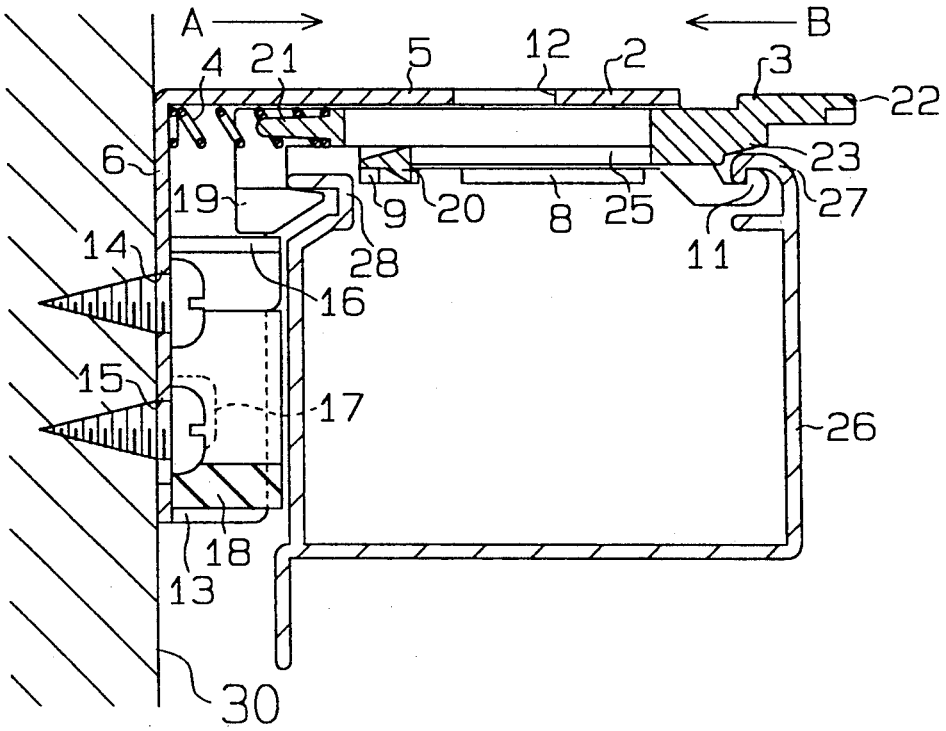
FIG. 2 is a cross section of the fixture showing a condition where a head box is supported thereon.

A head box 26 has an almost U-shaped cross section as shown in FIG. 2. An attaching piece 27 is formed by bending the front upper edge of the head box 26 inward. Similarly, an attaching piece 28 is formed by bending the rear upper edge outward.

Figure 1:
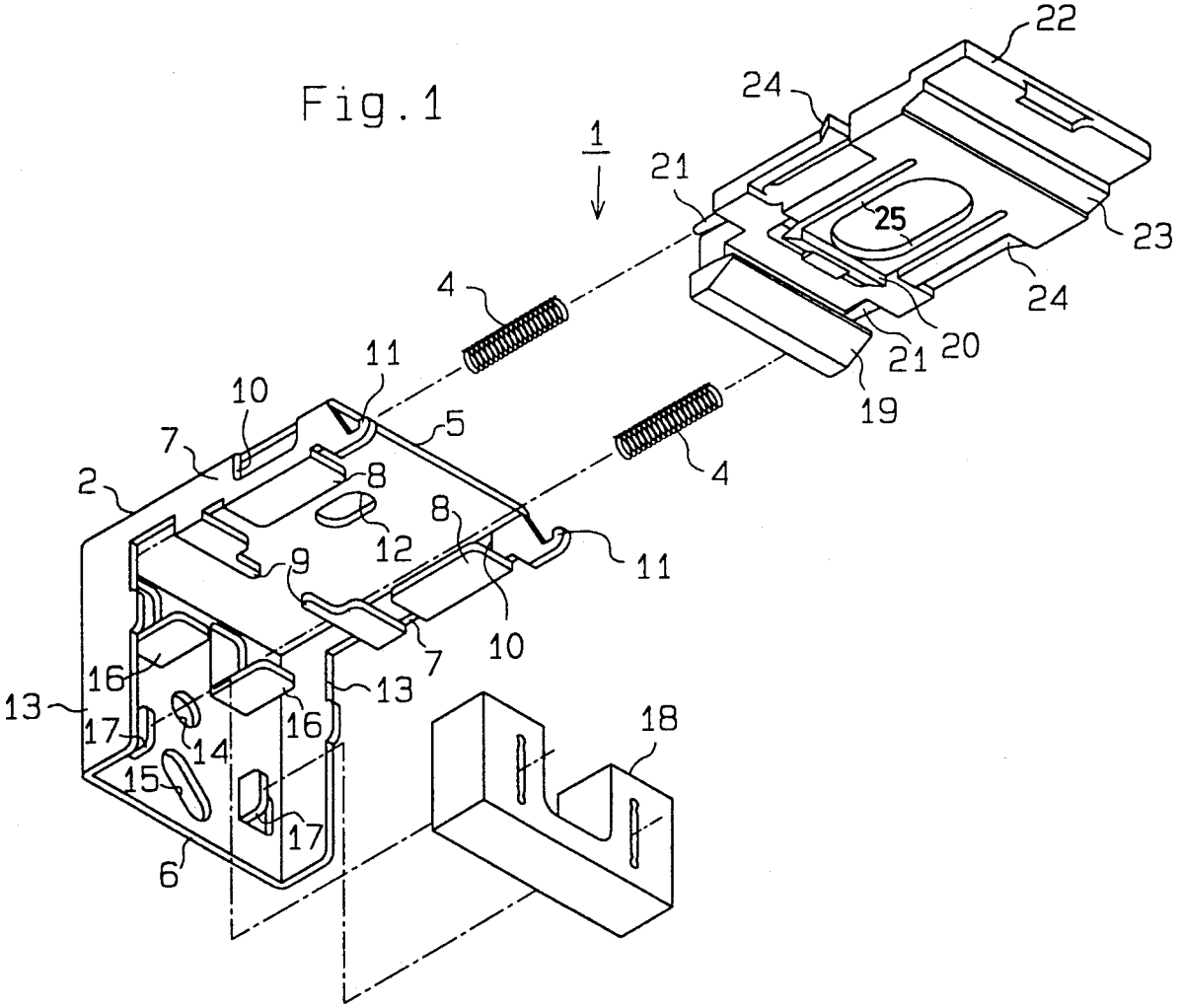
FIG. 1 is an exploded perspective view of a head box fixture in accordance with the present invention.

As shown in FIG. 1, a fixture 1 includes a frame 2, a slide block 3 made of synthetic resin, and two coil springs 4. The frame 2 is bent at 90 degrees in approximately the center, to have an almost inverted-L shape. The frame 2 includes a support plate 5 extending horizontally and an attaching plate 6 extending vertically.

The sides of the support plate 5 are folded downward to make side walls 7. A pair of guide pieces 8 are provided at the lower edges of the respective side walls 7. The guide walls are folded inward horizontally to face each other. The slide block 3 is inserted slidable in the horizontal direction between the support plate 5 and the guide pieces 8. A pair of horizontally extending, facing hooks 9 are formed at the lower edges of the respective side walls 7 behind the guide pieces 8. Both the guide pieces 8 and the hooks 9 are provided in approximately the same plane, with the hooks 9 protruding inward more than the guide pieces 8.

A support hook 11 is formed at the front end of each side wall 7 to hook the front edge of the head box 26. The side walls 7 have regulating holes 10 formed respectively in the middle portions to regulate the shifting range of the slide block 3. An attaching hole 12 is formed in the center of the support plate 5. The attaching hole permits the frame to be attached to a flat horizontal surface, such as a window frame or a ceiling. Side walls 13 which are positioned in the same plane as the side walls 7 are formed at the respective side edges of the attaching plate 6. Attaching holes 14 and 15 are formed in the center of the attaching plate 6. Accordingly, the frame 2 may be attached to a vertical surface 30, such as a window frame or a wall. Thus, the frame may be attached to either a horizontal or a vertical surface. Further, auxiliary supports 16 which extend horizontally are provided on the inner wall of the attaching plate 6. A pair of tabs 17 are located on the inner wall of the attaching plate 6 between the side walls 13. Each tab 17 has a cushion 18 made of rubber to prevent the head box 26 from directly contacting the frame 2.

Figure 3:
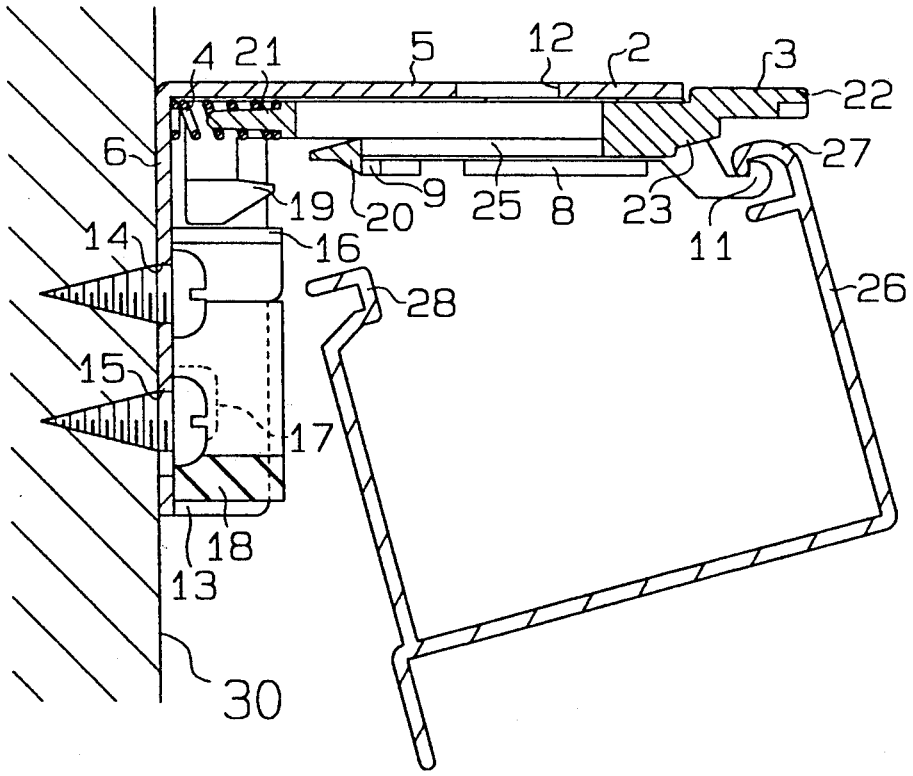
FIG. 3 is a cross section of the fixture showing a condition where the head box is in a release position.

A support bar 19 is formed at the rear end of the slide block 3 to hook the rear edge of the head box 26. When the slide block 3 is mounted on the frame 2, the support bar 19 is placed on the auxiliary supports 16. The activating piece contained in the slide block has a pair of spring tabs 25 that are cantilevered in the center of the slide block 3 such that they may be flexed upward and downward. The front proximal ends of the spring tabs 25 are integrally coupled to the slide block 3. A latch bar 20 is formed at the rear ends of the spring tabs 25. The latch bar 20 laterally between the spring tabs 25 and has a lip having a tapered leading edge that protrudes downward at a position in front of the support bar 19. As the slide block 3 is slide into place, the spring tabs 25 are deflected upward by the facing hooks 9. After the latch bar has passed over the hooks, the resiliency in the spring tabs 25 return the latch bar to its equilibrium position such that the latch bar 20 detachably engages the rear sides of the hooks 9, as shown in FIGS. 2 and 3.

The rear (proximal) ends of spring arms 24 are attached to the respective sides of the slide block 3 and may be flexed sideways. Latching portions for engaging regulating holes 10 are formed at the distal ends of the respective spring arms 24. When the slide block 3 is attached to the frame 2, the engagement of the latching portions of the spring arms 24 with the regulating holes 10 restricts the movement of the slide block 3 to the region between the two positions shown in FIGS. 2 and 3. The first of these positions is a release position where almost the entire support bar 19 is fitted in the side walls 13 above the auxiliary supports 16. In this position the support bar 19 is released from the head box 26 (see FIG. 3). The second position is a support position where part of the support bar 19 protrudes forward from the sidewalls 13 to support the rear edge of the head box 26 (see FIG. 2).

The slide block 3 has a pair of spring retainers 21 at the respective rear sides. Each spring retainer 21 has an associated coil spring 4. The coil spring 4 abuts on the attaching plate 6 to always urge the slide block 3 forward, i.e., in a direction indicated by an arrow A shown in FIG. 2. The slide block 3 also has a push bar 22 at the front end. If the push bar 22 is pushed against the force of the coil springs 4, that is, in the direction indicated by an arrow B shown in FIG. 2, the latch bar 20 slides over the hooks 9 to engage with the rear sides of the hooks 9, keeping the slide block 3 at the release position in FIG. 3. If the latch bar 20 is unhooked from the hooks 9 as shown in FIG. 2, the slide block 3 is shifted forward to the support position in FIG. 2 by the urging force of the coil springs 4.

A tapered surface 23, tapered from the rear portion to the front portion, is formed behind the push bar 22 on the bottom surface of the slide block 3. When the slide block 3 is placed at the release position, the gap between the tapered surface 23 and the support hooks 11 of the frame 2 is widened, whereas when the slide block 3 is located at the support position, that gap becomes narrower.

Figure 4:
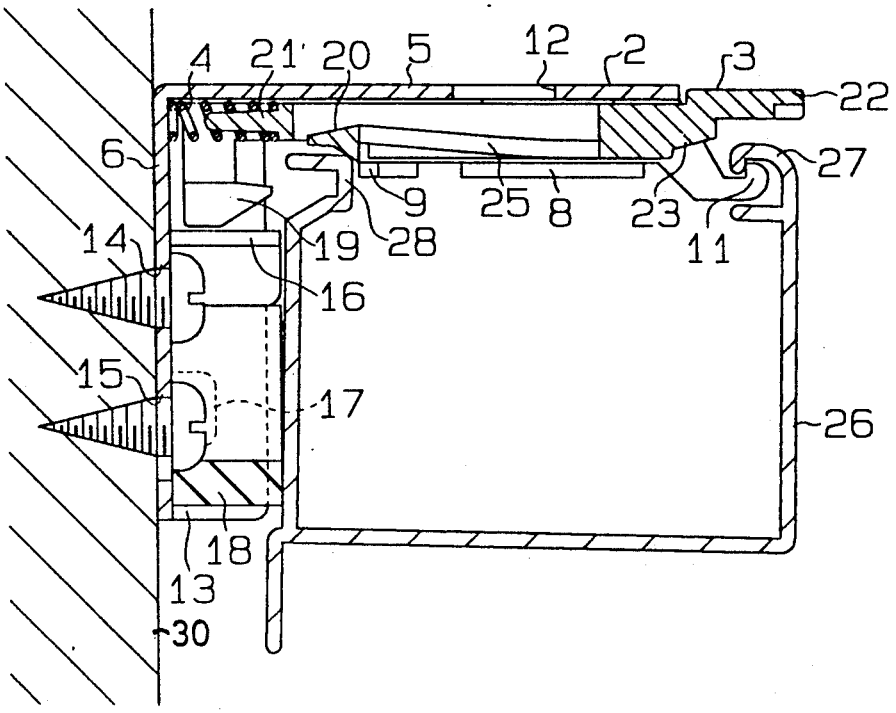
FIG. 4 is a cross section of the fixture showing a condition where a latch bar is pushed up by a rear attaching piece.
Figure 5:
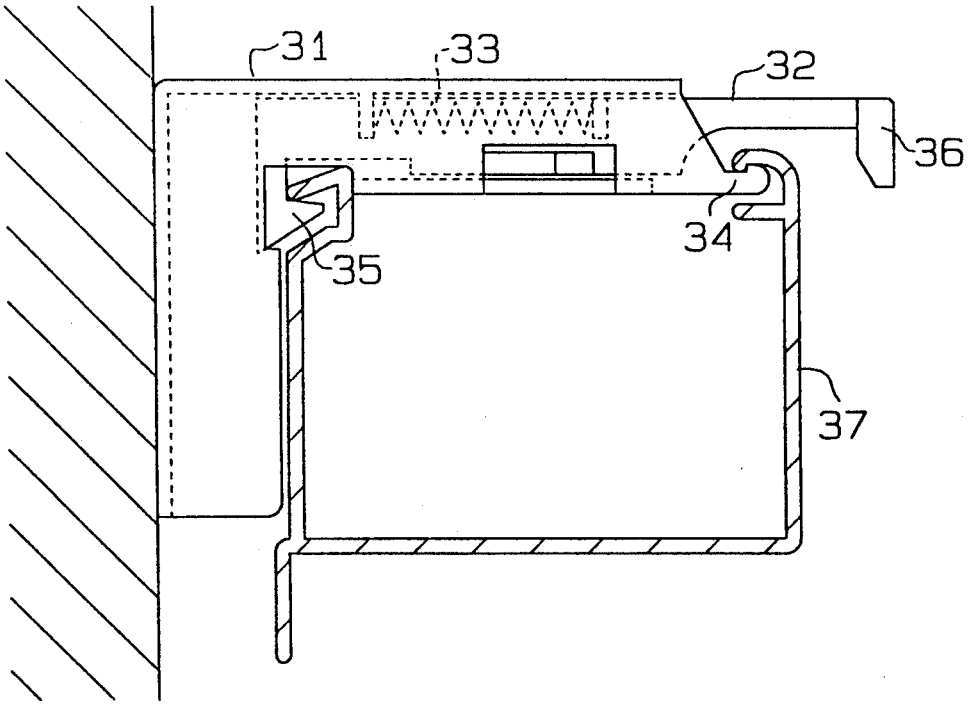
Fig. 5 (Prior Art)
FIG. 5 is a side view showing a conventional head box fixture.

To attach the head box 26 to the above-structured fixture 1, first, a plurality of fixtures 1 are attached to a window frame or the like at predetermined intervals as shown in FIG. 2. In each fixture 1, the push bar 22 of the slide block 3 is pushed against the coil springs 4 to place the slide block 3 at the release position shown in FIG. 3. The support bar 19 of the slide block 3 is then retained in the side walls 13, while the latch bar 20 goes over the hooks 9 of the frame 2 to be hooked at the rear sides of the hooks 9 and kept in such situation thereafter. The attaching piece 27 of the head box 26 is hooked at the support hooks 11 of the frame 2 at this time. The rear edge of the head box 26 is turned upward on the support hooks 11 to allow the attaching piece 28 to abut on the latch bar 20, and position in close proximity to the cushion 18. The latch bar 20 is then pushed upward by the attaching piece 28 to be released from the rear sides of the hooks 9 as shown in FIG. 4. The slide block 3 is urged forward by the coil springs 4, and placed at the support position. As a result, the support bar 19 protrudes forward from the side walls 13 on the auxiliary supports 16 to engage with the attaching piece 28 of the head box 26 upwardly. At the same time, the tapered surface 23 comes in the vicinity of the attaching piece 27 on the support hooks 11, narrowing the gap between the tapered surface 23 and the support hooks 11.

Under the above conditions, the rear portion of the head box 26 is securely supported by the coil springs 4 pressing the support bar 19 on the auxiliary supports 16 against the attaching piece 28. Since the tapered surface 23 is located near the attaching piece 27 over the support hooks 11, the front portion of the head box 26 is prevented from coming off from the support hooks 11 by accident.

In the above-described embodiment, pushing force of the attaching piece 28 will be required for attaching the head box 26 to push the latch bar 20 upward. This force is however much smaller than the conventionally required force. It is therefore possible to attach the head box 26 to all of the fixtures 1 at one time.

When the head box 26 is to be detached from the fixture 1, the push bar 22 of the slide block 3 is pushed backward against the force of the coil springs 4. The support bar 19 of the slide block 3 is then completely retained in the side walls 13. The latch bar 20 simultaneously goes over the hooks 9 of the frame 2 to be engaged with the rear sides of the hooks 9, and maintains that state. The support bar 19 is detached from the attaching piece 28 of the head box 26, and the tapered surface 23 moves backward from the attaching piece 27. The head box 26 can be easily detached from the fixture 1 in this manner.

Although only one embodiment of the present invention has been described in detail, it should be apparent to those skilled in the art that the present invention may be embodied in many other specific forms without departing from the spirit or scope of the invention. For example, it should be understood that the structures of the individual portions may be altered as follows.

1) The support hooks 11 of the frame 2 are provided at the rear portion of the fixture 1, while the support bar 19 of the slide block 3 is located at the front portion of the slide block 3. The attaching piece 27 of the head box 26 is supported by the support bar 19 of the slide block 3, while the attaching piece 28 is supported by the support hooks 11 of the frame 2. In this case the push bar 22 should be pulled to engage the hooks 9 with the latch bar 20.

2) The attaching plate 6 of the frame 2 may be eliminated in embodiments where the frame 2 is to be attached only to a horizontal surface, such as a ceiling.

Figure 6:
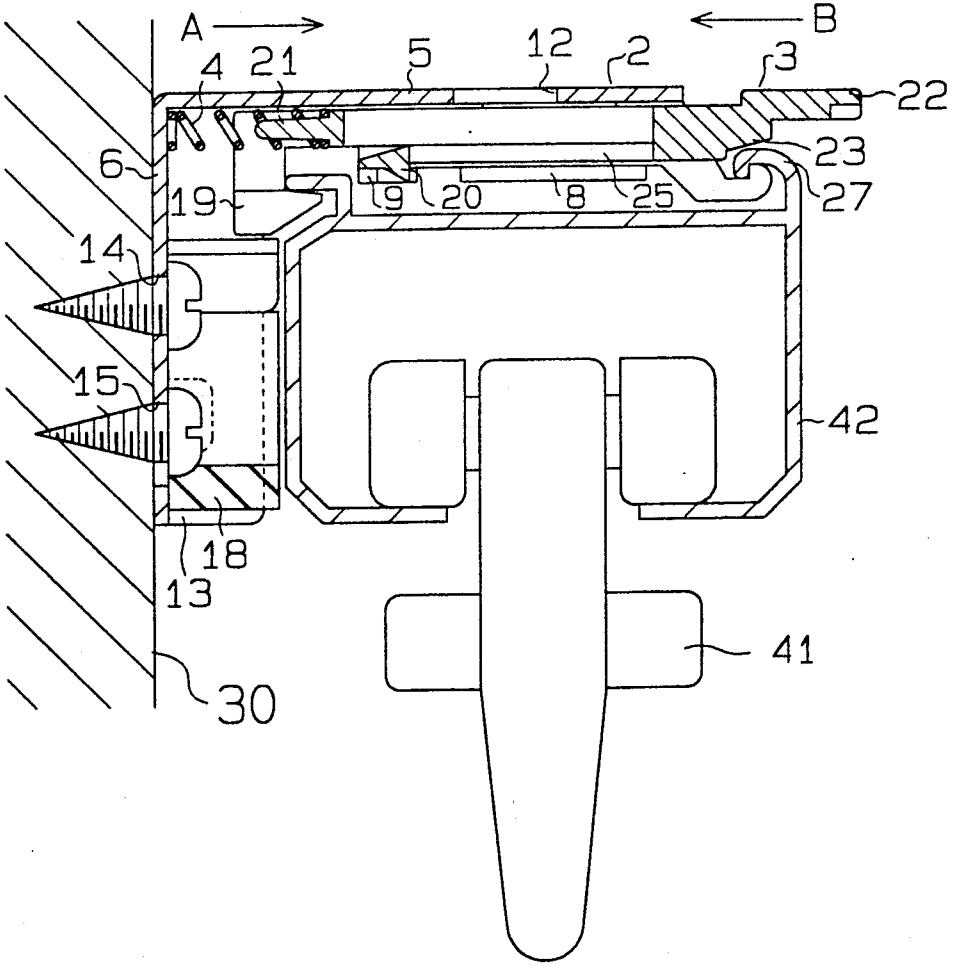
FIG. 6 is a cross section of a modification of the present invention.

3) The present invention may be applied to other rail members than a head box, for example, it may by applied to a fixture for a curtain rail 42 which has a runner 41 as shown in FIG. 6.

Therefore, the present examples and embodiments are to be considered as illustrative and not restrictive and the invention is not to be limited to the details given herein, but may be modified within the scope of the appended claims.

What is claimed is:

1. A rail attachment structure for securing a rail member to an attaching surface, comprising:

a frame to be attached to the attaching surface, and having a first support for supporting a first attaching piece of the rail member;

a slide block slidably attached to the frame and having a second support for supporting a second attaching piece of the rail member, the slide block being slidable between a supporting position where the second support is positioned to support the second attaching piece and a releasing position where the second support is released from the second attaching piece;

a spring for urging the slide block toward the support position; and an actuating piece, provided in the slide block and shiftable in a direction different from a sliding direction of the slide block, the actuating piece engaging with a first part of the frame to hold the slide block at the release position when the slide block is shifted to the release position, the actuating piece being shifted to disengage from the first part of the frame based on the engagement with the rail member when the second attaching piece of the rail member is shifted toward the slide block with the first attaching piece of the rail member held by the first support, thereby allowing the slide block to move toward the support position by the urging force of the spring.

2. A rail attachment structure according to claim 1, wherein the frame is folded at approximately 90 degrees, and includes a support plate extending substantially horizontally and an attaching plate extending substantially vertically.

3. A rail attachment structure according to claim 2, wherein attaching holes through which the frame may be attached to the attaching surface are formed in the both support plate and the attaching plate.

4. A rail attachment structure according to claim 2, wherein the slide block is slidably attached to the support plate.

5. A rail attachment structure according to claim 2, wherein guide pieces are formed on the support plate to guide the slide block.

6. A rail attachment structure according to claim 2, wherein the first support is formed at a front end of the support plate and the second support is formed at a rear end of the slide block.

7. A rail attachment structure according to claim 5, wherein hooks for engaging the actuating piece are formed on the support plate, behind the guide pieces.

8. A rail attachment structure according to claim 7, wherein the actuating piece comprises a pair of spring tabs coupled to a proximal end of the slide block, and a latch bar extending between and integrally formed with distal ends of the spring tabs, and the latch bar is detachably engaged with the hooks, when the rail member engages the latch bar.

9. A rail attachment structure according to claim 2, wherein side walls are provided on both side edges of the support plate and the attaching plate for reinforcement.

10. A rail attachment structure according to claim 6, wherein protruding pieces are formed on the attaching plate for auxiliary support of the second support of the slide block.

11. A rail attachment structure according to claim 2, wherein a cushion is provided on the attaching plate to prevent the direct contact of the rail member with the attaching plate when the rail member is supported by the first and second supports.

12. A rail attachment structure for fixing a rail member to an attaching surface, comprising:

a frame for attachment to the attaching surface, the frame having an approximately 90 degrees bend therein, the frame including a support plate extending substantially horizontally and an attaching plate extending substantially vertically, the support plate having a first support for supporting a first attaching piece of the rail member;

a slide block slidably attached to the frame and having a second support for supporting a second attaching piece of the rail member, the slide block being slidable between a supporting position where the second support can support the second attaching piece and a releasing position where the second support is released from the second attaching piece;

a spring for urging the slide block toward the support position; and an actuating piece, provided in the slide block and shiftable in a direction different from a sliding direction of the slide block, the actuating piece comprising a pair of spring tabs coupled to a proximal end of the slide block, and a latch bar integrally formed at distal ends of the spring tabs, the latch bar of the actuating piece being engaged with a part of the frame to hold the slide block at the release position when the slide block is shifted to the release position, the latch bar of the actuating piece being shifted to disengage from the part of the frame based on the engagement with the rail member when the second attaching piece of the rail member is shifted toward the slide block with the first attaching piece of the rail member held by the first support, thereby allowing the slide block to move toward the support position by the urging force of the spring.

13. A rail attachment structure according to claim 12, wherein guide pieces are formed on the support plate to guide the slide block.

14. A rail attachment structure according to claim 13, wherein hooks for engaging the actuating piece are formed on the support plate, behind the guide pieces.

* * * * *